US007321292B2

(12) United States Patent
Silver

(10) Patent No.: US 7,321,292 B2
(45) Date of Patent: Jan. 22, 2008

(54) RACING CONTROL SYSTEM

(76) Inventor: Bruce Silver, 112 Country Club Dr., Linwood, NJ (US) 08221

( * ) Notice: Subject to any disclaimer, the term of this patent is extended or adjusted under 35 U.S.C. 154(b) by 256 days.

(21) Appl. No.: 11/260,743

(22) Filed: Oct. 27, 2005

(65) Prior Publication Data

US 2006/0145891 A1 Jul. 6, 2006

Related U.S. Application Data

(60) Provisional application No. 60/622,364, filed on Oct. 27, 2004.

(51) Int. Cl.
*G08B 23/00* (2006.01)

(52) U.S. Cl. ..... 340/323 R; 340/902; 340/904; 340/988; 340/870.01; 340/439; 340/539.1; 340/539.16

(58) Field of Classification Search ..... 340/323 R, 340/902, 904, 988, 992, 870.01, 539.1, 539.16, 340/439; 701/24, 30, 31, 32, 35
See application file for complete search history.

(56) References Cited

U.S. PATENT DOCUMENTS 5,140,307 A * 8/1992 Rebetez et al. ..... 340/539.1
5,666,101 A * 9/1997 Cazzani et al. ..... 340/323 R
6,195,090 B1 * 2/2001 Riggins, III ..... 725/139

* cited by examiner

*Primary Examiner*—Hung Nguyen
(74) *Attorney, Agent, or Firm*—Akin Gump Strauss Hauer & Feld LLP

(57) ABSTRACT

A racing caution-condition control system includes a master control station and first and second caution-condition warning systems. The master control station has a master activation input and a transmitter, and the master activation input is coupled to the transmitter and selectively causes the transmitter to send a caution-condition signal output. The first caution-condition warning system has a first receiver in communication with the transmitter. The first caution-condition warning system is activated when the first receiver receives the caution-condition signal from the transmitter. The second caution-condition warning system, different from the first caution-condition warning system, has a second receiver in communication with the transmitter. The second caution-condition warning system is activated when the second receiver receives the caution-condition signal from the transmitter.

17 Claims, 8 Drawing Sheets

RACING CONTROL SYSTEM

CROSS REFERENCE TO RELATED APPLICATIONS

This application claims priority to Provisional Patent Application No. 60/622,364 filed on Oct. 27, 2004 entitled "Racing Control System."

BACKGROUND OF THE INVENTION

The present invention is directed to a race hazard or caution condition warning system, and more particularly, the present invention is directed to a master control for a race hazard or caution condition warning system.

Race hazard warning systems which signal warning lights on a racetrack are well known. Commonly, a pushbutton or switch is located at a flagman's stand such that either the flagman or an assistant triggers a yellow warning light when an accident or other caution-condition has occurred. Red warning lights are sometimes utilized to completely stop a race due to a severe accident or caution-condition.

There are occasionally problems with the flagman beginning to wave the yellow caution flag before the switch is thrown to energize the caution lights on the track and vice versa, or the opposite condition, when the light goes out before the flagman stops waving the flag and vice versa. Such differences in timing can cause disputes about when drivers began to slow down or when they permissibly began to speed up in response to the caution-condition as perceived from different vantage points around a closed course racetrack. For example, in a situation where there is a backup flagman or an assistant controlling the lights, the lights may be accidentally or mistakenly turned on by the backup flagman even though there was no actual caution-condition. Even if quickly turned off, some racers may be unfairly disadvantage by reacting to the false caution-condition signal.

Some racetrack systems have moved control of the lights up to the control tower, however, there is presently no master, simultaneous control of all of the caution lights (i.e., track lights, pit-row lights, emergency vehicle lights and on-board racing vehicle lights). It is desirable to provide a control system that provides for simultaneous and instantaneous activation of all of the race condition caution lights. Further, it is desirable to provide a control system that can interface with multiple, different, new and existing caution-condition warning lighting systems. Further, it is desirable to provide a control system that wirelessly controls multiple, different, new and existing caution-condition warning lighting systems.

BRIEF SUMMARY OF THE INVENTION

Briefly stated, the present invention comprises a racing caution-condition control system including a master control station and first and second caution-condition warning systems. The master control station has a master activation input and a transmitter, and the master activation input is coupled to the transmitter and selectively causes the transmitter to send a caution-condition signal output. The first caution-condition warning system has a first receiver in communication with the transmitter. The first caution-condition warning system is activated when the first receiver receives the caution-condition signal from the transmitter. The second caution-condition warning system, different from the first caution-condition warning system, has a second receiver in communication with the transmitter. The second caution-condition warning system is activated when the second receiver receives the caution-condition signal from the transmitter.

In another aspect, the present invention is a racing caution-condition control system including a master control station and first and second caution-condition warning systems. The master control station has a master activation input and a master spread-spectrum transceiver. The master activation input is coupled to the master spread-spectrum transceiver and selectively causes the master spread-spectrum transceiver to send a caution-condition signal output. The first caution-condition warning system has a first spread-spectrum transceiver in communication with the master spread-spectrum transceiver, and the first caution-condition warning system is activated when the first spread-spectrum transceiver receives the caution-condition signal from the master spread-spectrum transceiver. The second caution-condition warning system, different from the first caution-condition warning system, has a second spread-spectrum transceiver in communication with the master spread-spectrum transceiver, and the second caution-condition warning system is activated when the second spread-spectrum transceiver receives the caution-condition signal from the master spread-spectrum transceiver.

The present invention also comprises a racing caution-condition control system including a master control station, a track caution-condition warning system, a pit-row caution-condition warning system and an on-board vehicle caution-condition warning system. The master control station has a master activation input and a transmitter. The master activation input is coupled to the transmitter and selectively causes the transmitter to send a caution-condition signal output. The track caution-condition warning system has a track receiver in communication with the transmitter, and the track caution-condition warning system is activated when the track receiver receives the caution-condition signal from the transmitter. The pit-row caution-condition warning system has a pit-row receiver in communication with the transmitter, and the pit-row caution-condition warning system is also activated when the pit-row receiver receives the caution-condition signal from the transmitter. The on-board vehicle caution-condition warning system has at least one on-board vehicle receiver in communication with the transmitter, and the at least one on-board vehicle caution-condition warning system is also activated when the at least one on-board vehicle receiver receives the caution-condition signal, directly or indirectly, from the transmitter.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
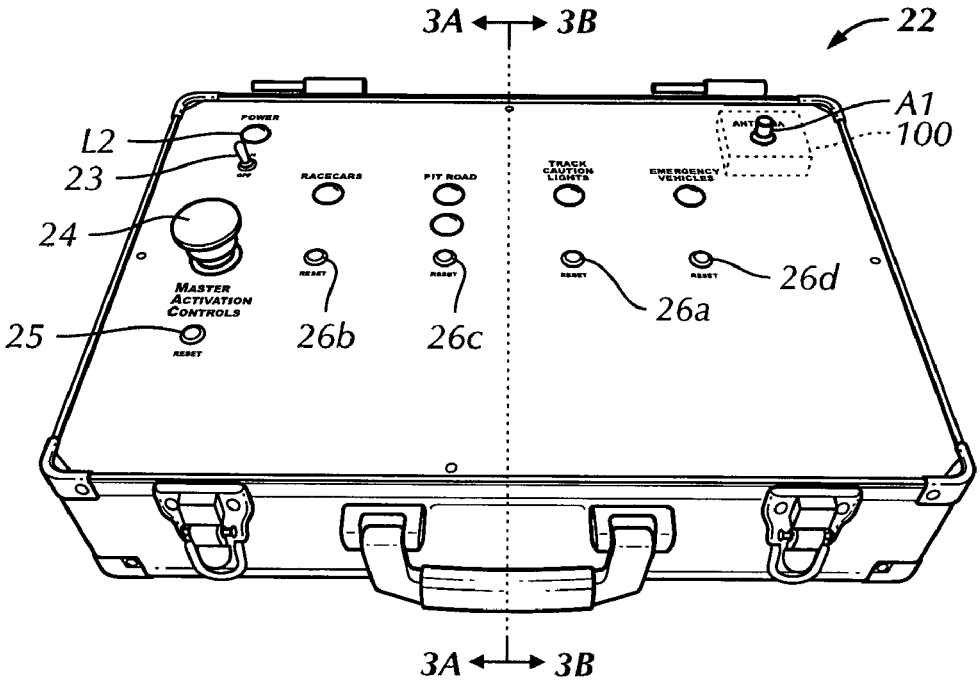
FIG. 1 is a perspective view of a master control station for a caution-condition control system in accordance with a preferred embodiment of the present invention.
Figure 2:
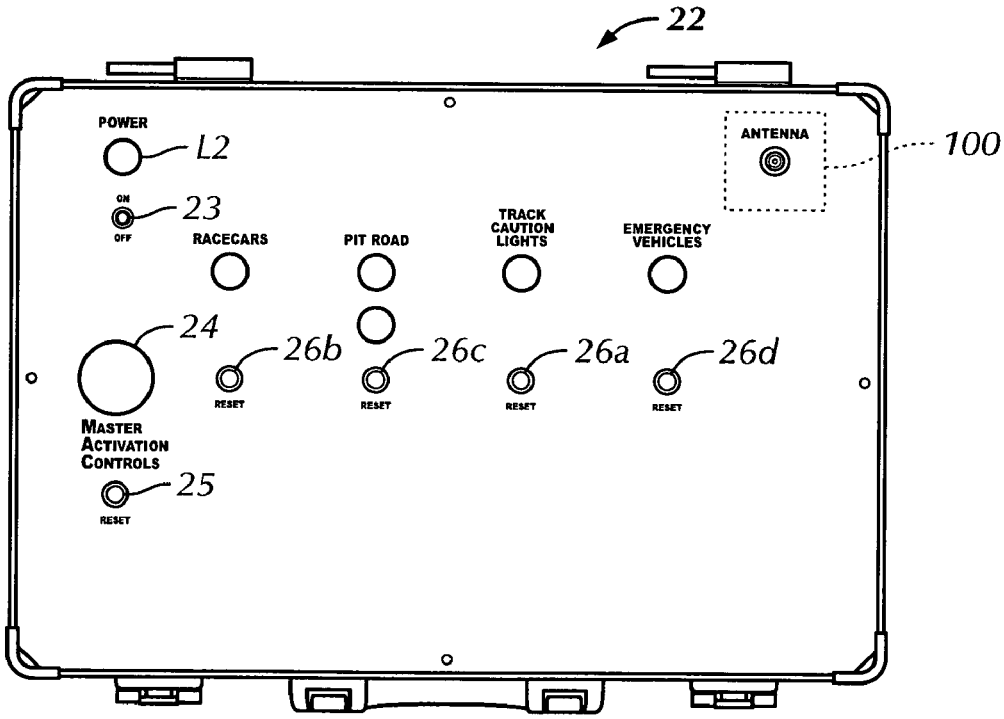
FIG. 2 is a top view of the master control station of FIG. 1.
Figure 3A:
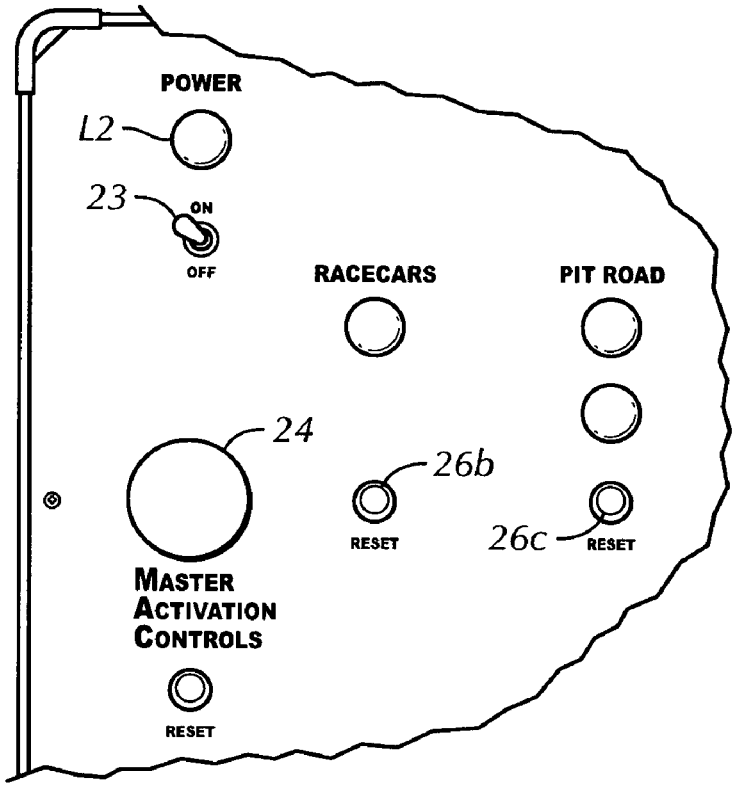
FIG. 3A is an enlarged top view of the master control station of FIG. 1.
Figure 3B:
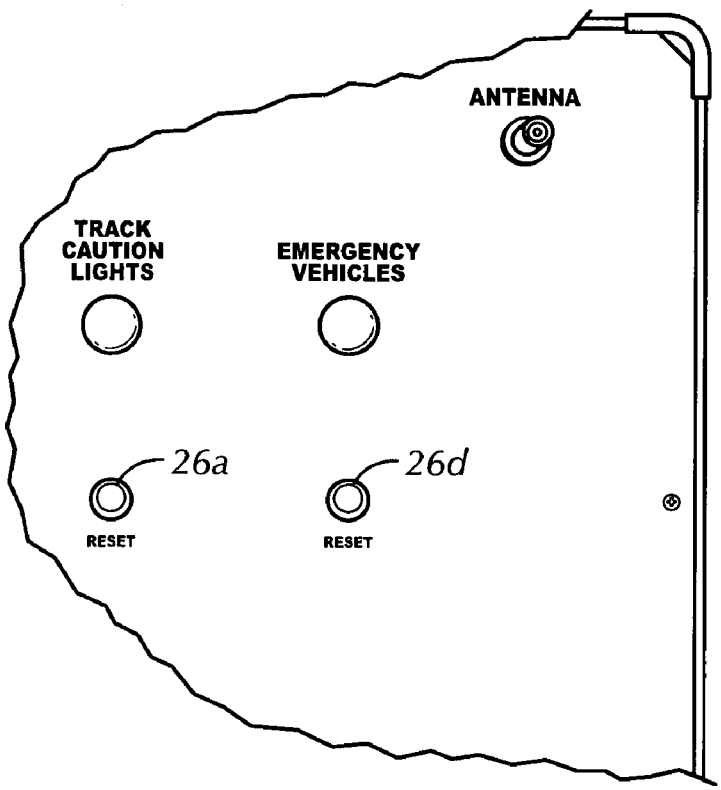
FIG. 3B is an enlarged top view of the master control station of FIG. 1.

Certain terminology is used in the following detailed description for convenience only and is not limiting. The words "right," "left," "lower" and "upper" designate directions in the drawings to which reference is made. The words "inwardly" and "outwardly" refer to directions toward and away from, respectively, the geometric center of the described device and designated parts thereof. The terminology includes the words above specifically mentioned, derivatives thereof and words of similar import. Additionally, the word "a," as used in the claims and in the corresponding portions of the specification means "one" or "at least one."

Figure 8:
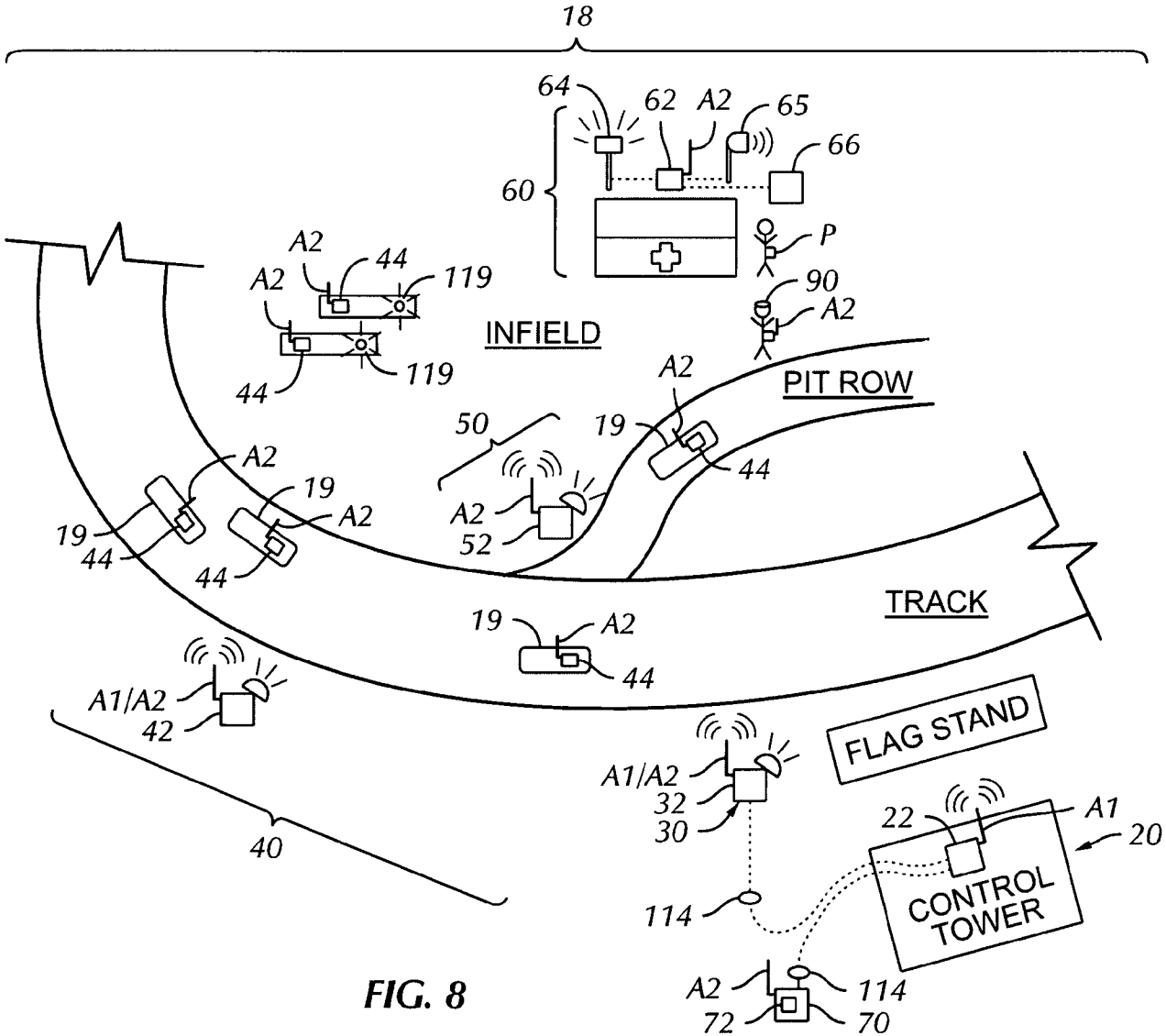
FIG. 8 is a schematic diagram of a racetrack which utilizes the preferred embodiments of the present invention.

Referring to the drawings in detail, wherein like numerals represent like elements throughout, FIG. 8 is a schematic diagram of a racetrack 18 which utilizes the preferred embodiments of the present invention. The racetrack 18 as used herein refers collectively to the site or arena where a race takes place including a track or course itself, pit row, an in field (area within the track), a flag stand, seating and a control tower. During a typical race event, there are a plurality of race vehicles 19 racing around the track or entering or leaving pit row. FIG. 8 shows multiple systems 20, 30, 40, 50, 60, 70, 90 integrally operating at a racetrack 18.

FIGS. 1-2, 3A-3B show the components of a racing hazard or caution-condition control system 20 including a master control station 22 and first and second caution-condition warning systems 30, 40, in accordance with a preferred embodiment of the present invention. The master control station 22 has a master activation input 24 and a transmitter 100, and the master activation input 24 is coupled to the transmitter 100 and selectively causes the transmitter 100 to send a caution-condition signal output. The first caution-condition warning system 30 has a first receiver 32 in communication with the transmitter 100 of the master control station 22. The first caution-condition warning system 30 is activated when the first receiver 32 receives the caution-condition signal from the transmitter 100. The second caution-condition warning system 40, different from the first caution-condition warning system 30, has a second receiver 42, which is a transceiver in some instances as described below, in communication with the transmitter 100 of the master control station 22. The second caution-condition warning system 40 is activated when the second receiver 42 receives the caution-condition signal from the transmitter 100 of the master control station 22. The first and second receiver 32, 42 each include a receiver circuit 110 (FIG. 10).

Figure 10:
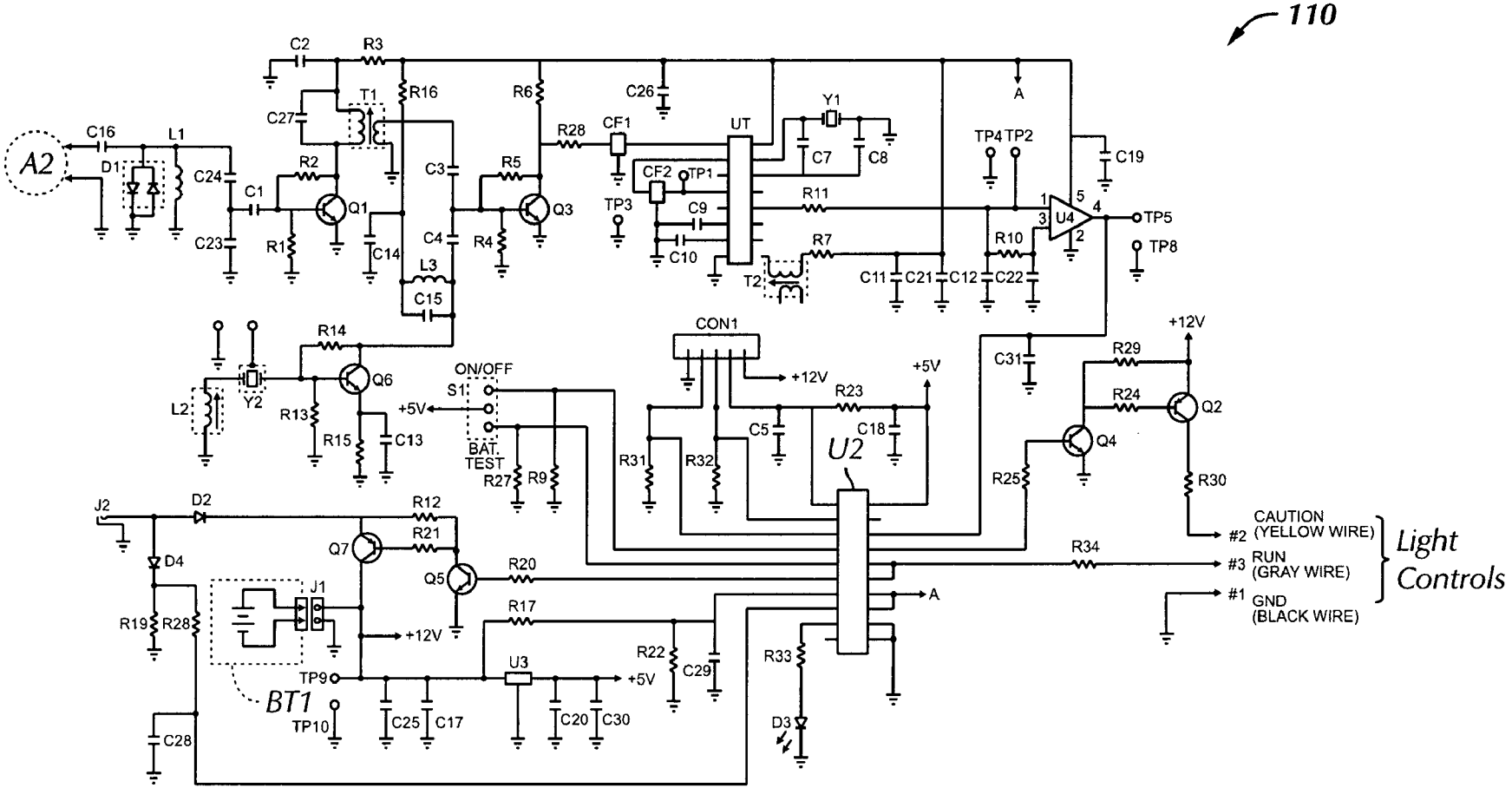
FIG. 10 is an electrical schematic of a receiver circuit in accordance with the preferred embodiments of the present invention.
Figure 11:
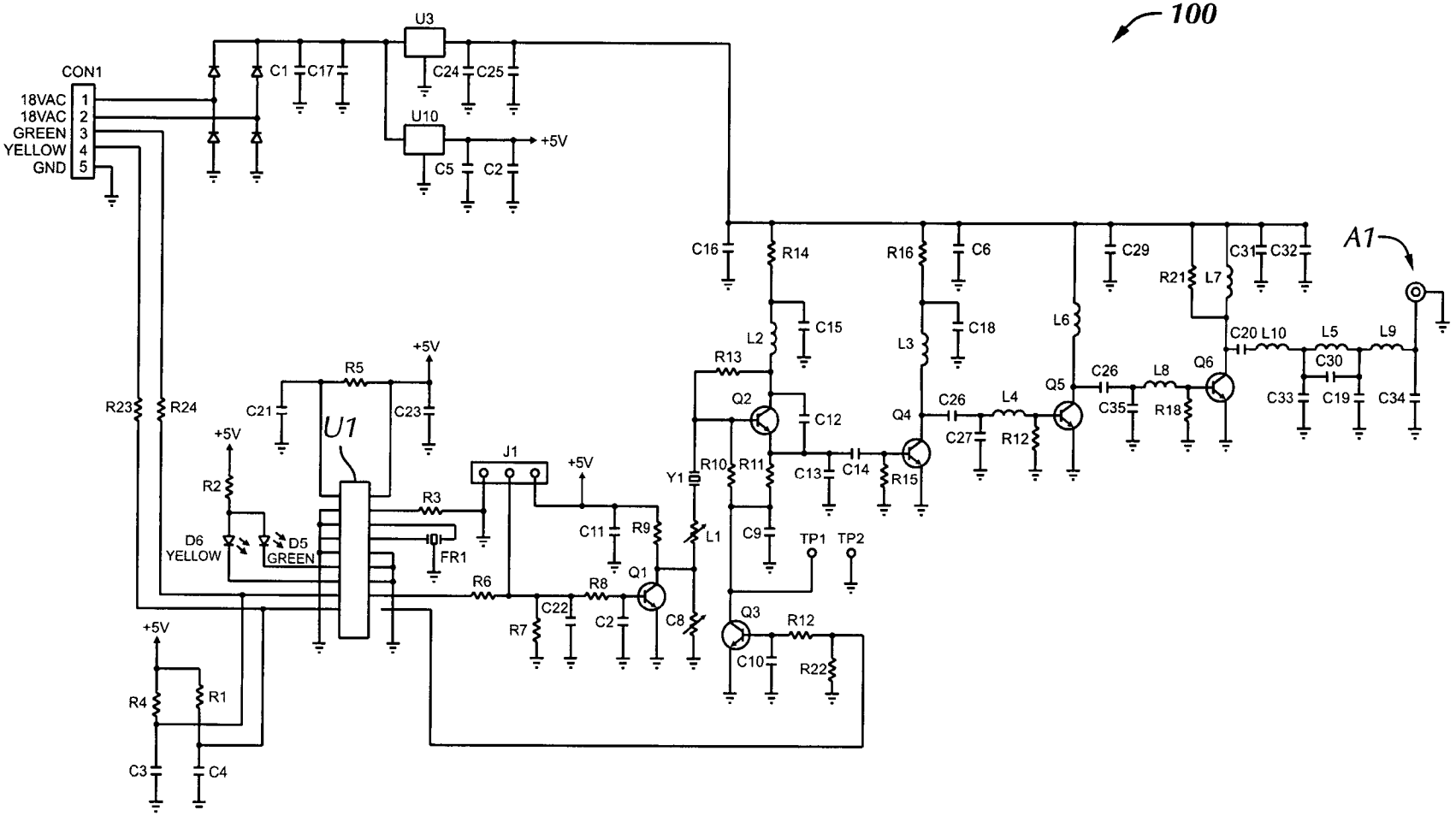
FIG. 11 is an electrical schematic of a transmitter circuit in accordance with the preferred embodiments of the present invention.

FIG. 10 is an electrical schematic of the receiver circuit 110 in accordance with the preferred embodiments of the present invention. FIG. 11 is an electrical schematic of the transmitter circuit 100 in accordance with the preferred embodiments of the present invention. Combining the transmitter and receiver circuits 100, 110 into one circuit can create a transceiver (i.e., a transmitter and receiver or a receiver and re-transmitter) or a repeater.

The transmitter circuit 100 includes a controller U1 and associated circuitry necessary to broadcast a wireless signal from an antenna A1. The controller U1 may be a microprocessor, a microcontroller, an application specific integrated circuit (ASIC) and the like. The transmitter circuit 100 receives power from an 18 volt alternating current (AC) source so that the transmitter circuit 100 can have a battery back-up. Other voltage levels can be utilized without departing from the present invention. The transmitter circuit 100 broadcasts a wireless radio-frequency (RF) signal through antenna A1. In the present embodiment, the transmitter circuit 100 broadcasts at about 27.145 megahertz (MHz) narrow-band frequency modulation (FM). The transmitter circuit 100 as shown in FIG. 11 is configured for about a 4 watt transmission having a range of several miles. Other detailed analog or digital circuitry, other power levels, other transmission frequencies and the like may be utilized without departing from the present invention.

The transmitter circuit 100 preferably encodes, using an encoder circuit, a signal so that the receiver circuits 110 do not receive inadvertent signals or noise from other sources which might cause inadvertent and undesired false trips of the caution-condition. The encoding is pulse-code modulated (PCM), but other encoding and transmitting methodologies may be utilized such as pulse width modulation (PWM), pulse amplitude modulation (PAM), pulse position modulation or pulse phase modulation (PPM) and the like. Optionally, the caution-condition signal output is digitally encrypted using any secure encryption scheme to prevent unauthorized tampering or hacking of the system for safety and security purposes.

Optionally, the transmitter circuit 100 includes outputs for hardwired signals 114 (FIG. 8) such as dry-contact outputs for activating devices that are permanently mounted, or for redundancy (e.g., 30 in FIG. 8) or for devices that are not wireless capable.

The master control station 22 includes an on/off switch 23 and on/off indicator light L2. The on/off switch 23 is preferably comprised of a two-way toggle button. Other switches and lights may be utilized without departing from the present invention.

The receiver circuit 110 includes a controller U2 and associated circuitry necessary to receive a wireless signal from an antenna A2. The controller U2 may be a microprocessor, a microcontroller, an ASIC and the like. The receiver circuit 110 receives power from an 18 volt AC source so that the receiver circuit 110 can have a battery back-up. Other voltage levels can be utilized without departing from the present invention. The receiver circuit 110 receives a wireless RF signal through antenna A2. In the present embodiment, the receiver circuit 110 receives at about 27.145 MHz narrow-band FM. The receiver circuit 110 preferably decodes, using an decoder circuit, the signal so that the receiver circuits 110 do not receive inadvertent signals or noise from other sources which might cause inadvertent and undesired false trips of the caution-condition. The decoder naturally must utilize a decoding method that corresponds to the encoder of the transmitter 100. Other data transmission methods may also be utilized which permit data packets, error checking, bidirectional communication and addressing.

Optionally, the receiver circuit 110 includes inputs for hardwired signals 114 (FIG. 8) for activating devices that are permanently mounted, existing or for redundancy (e.g., 30 in FIG. 8).

Optionally, the racing caution-condition control system 20 includes repeaters (not shown) which have transceivers 100 and 110 that are configured to retransmit the caution-condition signal output and the reset signals to improve range and signal strength of the broadcast The master control station 22 further includes a master reset input 25 that is coupled to the transmitter circuit 100 and selectively causes the transmitter circuit 100 to deactivate the caution-condition signal output and/or temporarily send a reset signal output. The master control station 22 may also include a first reset input 26*a* that is coupled to the transmitter circuit 100 and selectively causes the transmitter circuit 100 to at least temporarily send a first caution-condition warning system reset signal output. The master control station 22 may also include a second reset input 26*b* that is coupled to the transmitter circuit 100 and selectively causes the transmitter circuit 100 to at least temporarily send a second caution-condition warning system reset signal output. The master control station 22 may also include a third reset input 26*c* that is coupled to the transmitter circuit 100 and selectively causes the transmitter circuit 100 to at least temporarily send a third caution-condition warning system reset signal output. Likewise, in addition to or separately from the master reset input 25, the master control station 22 may include an individual reset input 26*a*-26*d* for each respective caution-condition warning system 30, 40, 50, 60, 70, 80, 90 that is coupled to the transmitter circuit 100 and selectively causes the transmitter circuit 100 to at least temporarily send a respective caution-condition warning system reset signal output. For example, individual resets 26*a*-26*d* may allow the track and pit-row to remain under caution while emergency vehicles or an emergency pager can be reset (deactivated).

The transmitter and receiver circuits 100, 110 may optionally include specific identification data embedded into the broadcast signal for a particular racetrack 18, e.g., Dover Downs, or for a particular type of race, e.g., cart racing or NASCAR® racing (NASCAR is a registered trademark of National Association for Stock Car Auto Racing, Inc., Daytona Beach, Fla.).

In one embodiment, master control station 22 has a master activation input 24 and a master spread-spectrum transceiver 100 and 110. The master activation input 24 is coupled to the master spread-spectrum transceiver 100 and 110 (similar to a combination of the circuits of FIGS. 10-11 but with a spread-spectrum circuit design) and selectively causes the master spread-spectrum transceiver 100 and 110 to send a caution-condition signal output. The first caution-condition warning system 30 has a first spread-spectrum transceiver 32 in communication with the master spread-spectrum transceiver 100/110, and the first caution-condition warning system 30 is activated when the first spread-spectrum transceiver 32 receives the caution-condition signal from the master spread-spectrum transceiver 100/110. The second caution-condition warning system 40, different from the first caution-condition warning system 30, has a second spread-spectrum transceiver 42 in communication with the master spread-spectrum transceiver 100/110, and the second caution-condition warning system 40 is activated when the second spread-spectrum transceiver 42 receives the caution-condition signal from the master spread-spectrum transceiver 100/110. Preferably, the first and second spread-spectrum transceivers 100 and 110 are configured to retransmit the caution-condition signal output and the reset signals to improve range and signal strength of the broadcast.

FIG. 8 shows that the racing caution-condition control system 20 can include not only the master control station 22, but also a track caution-condition warning system 30, a pit-row caution-condition warning system 50 and an on-board vehicle caution-condition warning system 40. The track caution-condition warning system 30 has a track receiver 32, having a receiver circuit 110 as described above, in communication with the transmitter 100 of the master control station 22, and the track caution-condition warning system 30 is activated when the track receiver 32 receives the caution-condition signal from the transmitter 100 of the master control station 22. The track caution-condition warning system 30 may receive both wireless signals at its receiver 32 and a redundant hardwired signal 114. The pit-row caution-condition warning system 50 has a pit-row receiver 52, having a receiver circuit 110 as described above, in communication with the transmitter 100 of the master control station 22, and the pit-row caution-condition warning system 50 is also activated when the pit-row receiver 52 receives the caution-condition signal from the transmitter 100 of the master control station 22. The on-board vehicle caution-condition warning system 40 has at least one on-board vehicle receiver 44, having a receiver circuit 110 as described above, in communication with the transmitter 100 of the master control station 22, and the at least one on-board vehicle caution-condition warning system 40 is also activated when the at least one on-board vehicle receiver 44 receives the caution-condition signal, directly or indirectly, from the transmitter 100 of the master control station 22.

Figure 4:
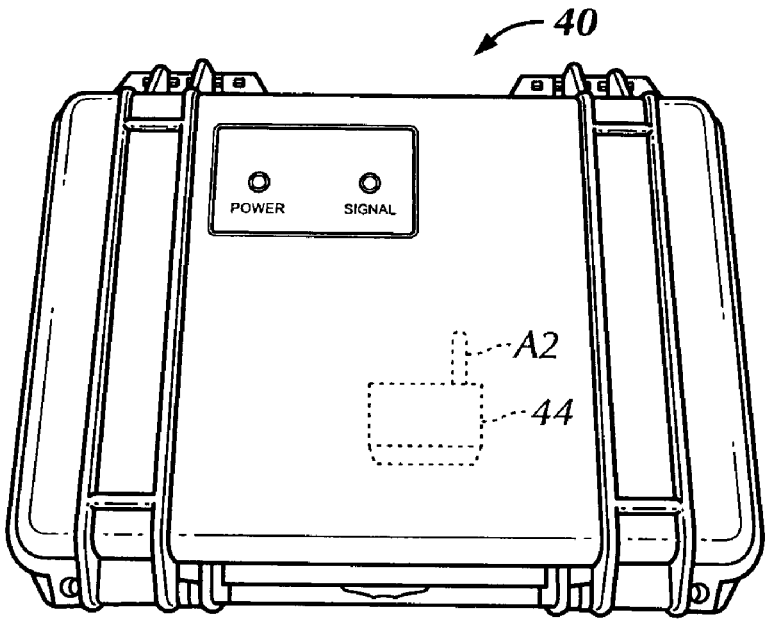
FIG. 4 is a perspective view of an on-board vehicle caution-condition warning system in accordance with a preferred embodiment of the present invention.
Figure 5:
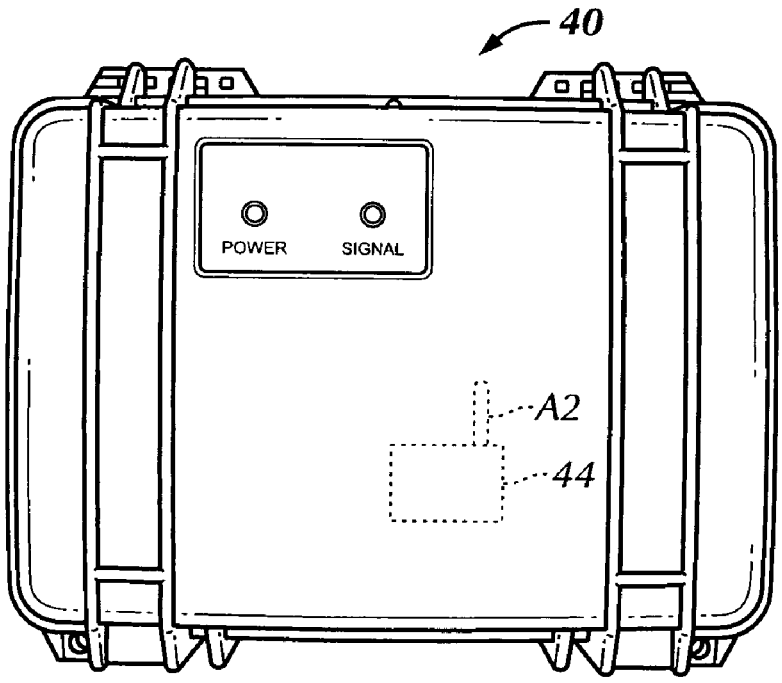
FIG. 5 is a top view of the on-board vehicle caution-condition warning system of FIG. 4.

FIGS. 4-5 show an on-board vehicle caution-condition warning system 40 in accordance with a preferred embodiment of the present invention. Each race vehicle 19 has its own on-board vehicle receiver 44. Emergency vehicles 119 may also include their own on-board vehicle receivers 44. The racing caution-condition control system 40 includes an on-board vehicle master transceiver 42 that receives the caution-condition signal from the transmitter 100 of the master control station 22 and re-transmits the caution-condition signal to the plurality of on-board vehicle caution-condition warning systems 44. Preferably, the master transceiver 42 is located in a fixed position proximate the track for broadcasting a signal that reaches every area around the track. The master transceiver 42 may receive the signal from the transmitter 100 of the master control station 22 which utilizes a first encoding method and carrier frequency and then retransmit to the on-board vehicle caution-condition warning systems 40 of the race vehicles 19 using a second, different encoding method and carrier frequency. The master transceiver 42 may also be configured to receive a plurality of different signals using a plurality of different protocols and then retransmit the data to the on-board vehicle caution-condition warning systems 40 of the race vehicles 19 using a common encoding method and carrier frequency.

Figure 9:
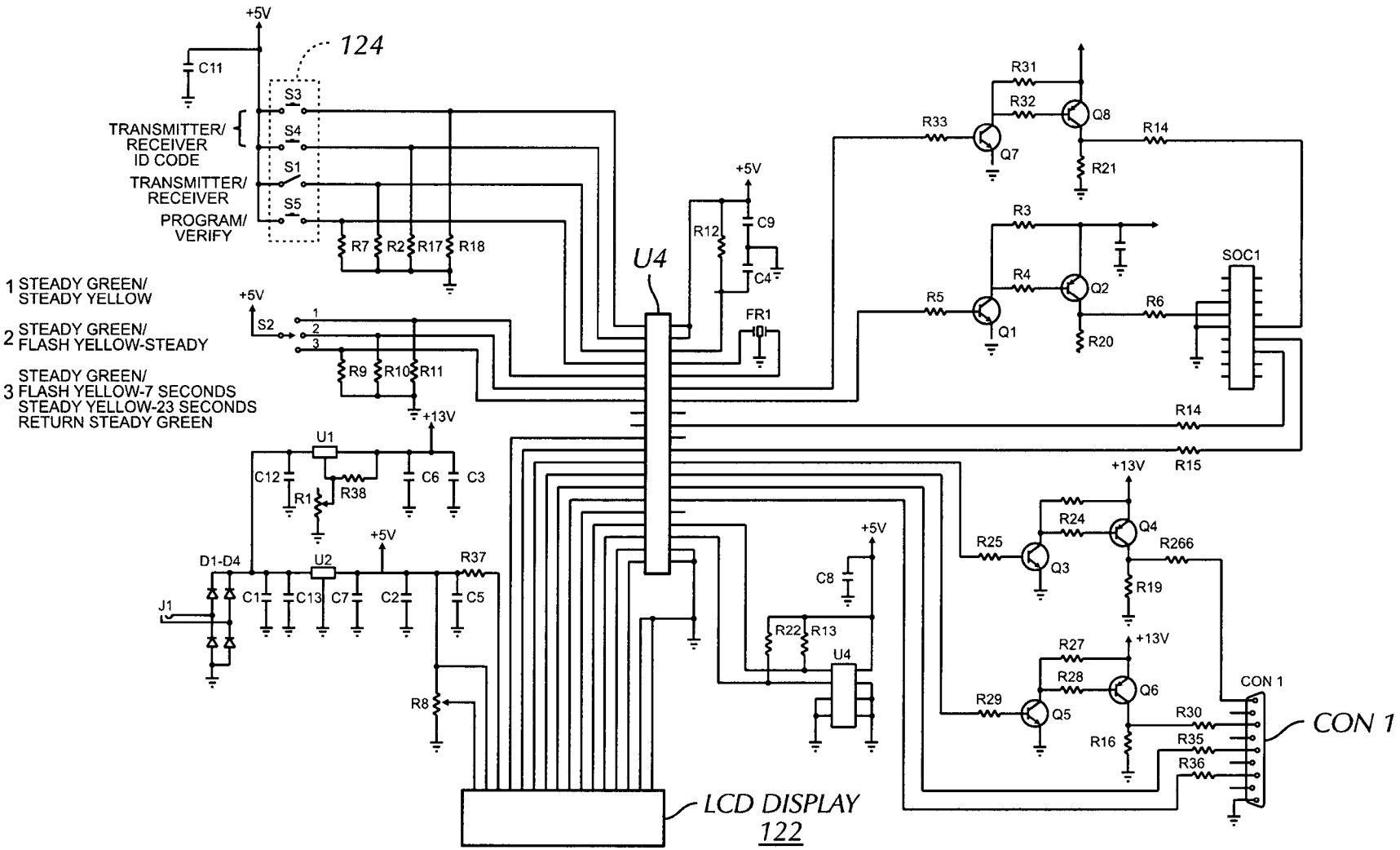
FIG. 9 is an electrical schematic of a programming circuit for the on-board vehicle caution-condition warning system of FIG. 4.

FIG. 9 is an electrical schematic of a programming circuit 120 for the on-board vehicle caution-condition warning system 40. Since each on-board vehicle caution-condition warning system 40 can have a unique identification code, the programming circuit 120 is used to interface with the transmitter and receiver circuits 100, 110 of the on-board vehicle caution-condition warning system 40 to program that unique identification code. The programming circuit 120 includes a controller U4, a liquid crystal display (LCD) 122, a keypad 124 and a communication connector CON 1. A user uses the keypad 124 to select software menu choices available in the memory of the controller U4 and as displayed on the LCD 122 to choose a particular code. The communication connector CON 1 couples with corresponding connectors (not shown) on the transmitter and receiver 100, 110 in order to download to the respective controller U1, U2. Other programming circuits 120 may be utilized without departing from the present invention. For example, software running in a conventional personal computer and a cable such as a serial cable or universal serial bus (USB) cable may be used to program the controller U1, U2 of the transmitter and receiver 100, 110, respectively.

The racing caution-condition control system 20 may also include an emergency medical-staff notification system 60 having an emergency medical-staff receiver 62 and a warning device 64, 65. The emergency medical-staff receiver 62 has a receiver circuit 110 as described above that receives the caution-condition signal from the transmitter 100 of the master control station 22 and activates the warning device 64, 65, 66. The warning device may be any one of a siren or horn 64, an indicator light or beacon 65 and a dialer 66.

The racing caution-condition control system 20 may also include an emergency pager system 70 having at least one pager P and an emergency pager receiver 72. The emergency pager receiver 72 has a receiver circuit 110 as described above that receives the caution-condition signal from the transmitter 100 of the master control station 22 and activates the at least one pager P.

Figure 6:
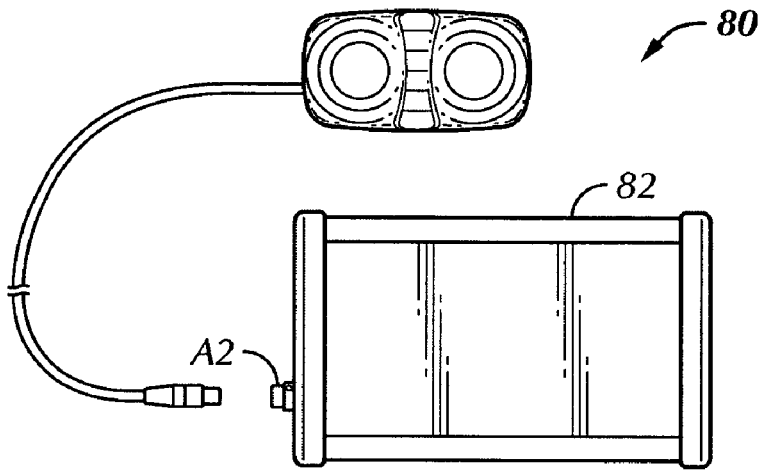
FIG. 6 is a perspective view of a caution-condition warning system receiver.

FIG. 6 shows portable caution-condition warning system 80 having portable receiver 82 that has a receiver circuit 110 as described above. The portable receiver 82 includes outputs for controlling new and existing emergency systems 30, 40, 50, 60, 70, such as dry contacts or a digital data signal. The portable receiver 82 permits an existing hardwired system that is locally controlled to be easily upgraded to a device that receives wireless or hardwired signals from the master station 22. For example, an existing track lighting system operated by a locally mounted switch at the flag stand can have a portable receiver 82 wired in parallel with the locally mounted switch (not shown), or as a replacement for the locally mounted switch, so as to be controlled simultaneously with the other emergency systems 30, 40, 50, 60, 70 from the master station 22 which is likely located in the control tower.

Figure 7:
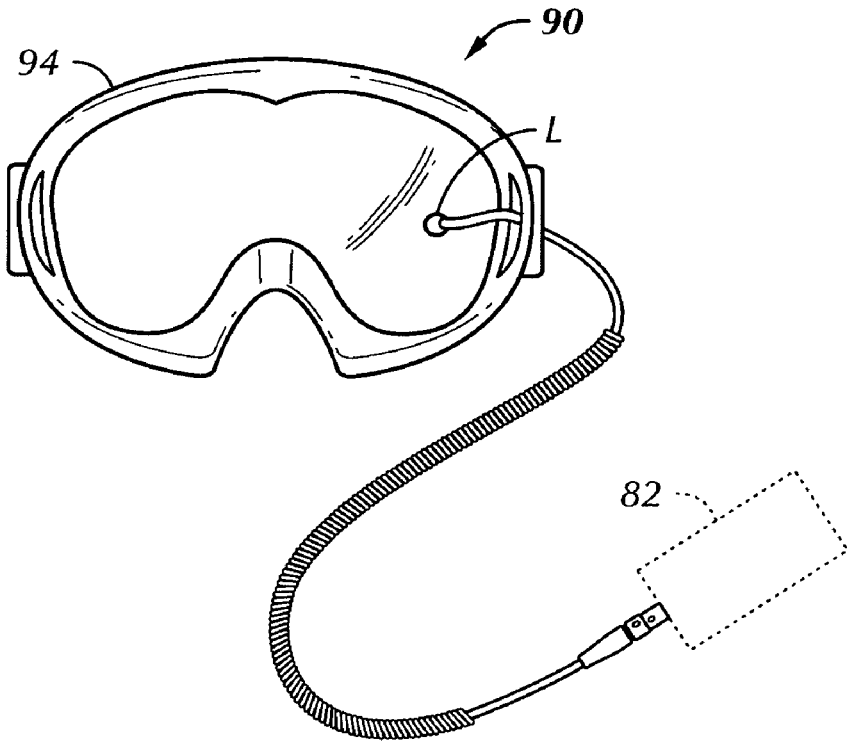
FIG. 7 is a front elevational view of a personal caution-condition warning system.

FIG. 7 shows a personal caution-condition warning system 90 which might be worn by a vehicle operator, i.e., a racecar driver, or a member of a pit team or emergency response team located proximate to the track where noise conditions are harsh. The personal caution-condition warning system 90 includes an indicator light L in the field of view of a pair of safety goggles 94. The indicator light L is configured to receive a control signal from a portable receiver 82. The indicator light L can be any type of visual indicator such as an incandescent bulb, an LED, an LCD, a heads-up display and the like.

Thus, the racing caution-condition control system 20 can simultaneously and instantly activate a caution-condition in a plurality of different caution-condition warning systems 30, 40, 50, 60, 70, 80, 90, so that all of the warning systems 30, 40, 50, 60, 70, 80, 90 operate in concert.

Of course, the racing caution-condition control system 20 is not limited to use with caution-condition warning systems 30, 40, 50, 60, 70, 80, 90, described above, but may also be used in conjunction with other systems such as electronic scoring, timer control and the like.

The various control circuits 100, 110, 120 could each be implemented on a single circuit board or other various combinations of circuit boards and circuit implementations without departing from the present invention.

From the foregoing, it can be seen that the present invention comprises a racing caution-condition control system and more particularly, a master control for a race hazard or caution condition warning system. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A racing caution-condition control system comprises:

a master control station having a master activation input and a transmitter, the master activation input being coupled to the transmitter and selectively causing the transmitter to send a caution-condition signal output;

a first caution-condition warning system that has a first receiver in communication with the transmitter, the first caution-condition warning system being activated when the first receiver receives the caution-condition signal from the transmitter; and a second caution-condition warning system, different from the first caution-condition warning system, that has a second receiver in communication with the transmitter, the second caution-condition warning system being activated when the second receiver receives the caution-condition signal from the transmitter.

2. The racing caution-condition control system according to claim 1, wherein the master control station further comprises a master reset input that is coupled to the transmitter and selectively causes the transmitter to deactivate the caution-condition signal output and/or temporarily send a reset signal output.

3. The racing caution-condition control system according to claim 1, wherein the master control station further comprises a first reset input that is coupled to the transmitter and selectively causes the transmitter to at least temporarily send a first caution-condition warning system reset signal output.

4. The racing caution-condition control system according to claim 1, wherein the master control station further comprises a second reset input that is coupled to the transmitter and selectively causes the transmitter to at least temporarily send a second caution-condition warning system reset signal output.

5. The racing caution-condition control system according to claim 1, wherein the master control station further comprises:

a first reset input that is coupled to the transmitter and selectively causes the transmitter to at least temporarily send a first caution-condition warning system reset signal output; and a second reset input that is coupled to the transmitter and selectively causes the transmitter to at least temporarily send a second caution-condition warning system reset signal output.

6. The racing caution-condition control system according to claim 1, wherein the transmitter outputs a wireless signal.

7. The racing caution-condition control system according to claim 1, wherein the transmitter outputs a wireless signal to one of the first and second receiver and by a hardwired signal to the other of the first and second receiver.

8. The racing caution-condition control system according to claim 1, wherein the transmitter and the first and second receivers are transceivers configured for bidirectional communication in order to provide status and error checking signals.

9. The racing caution-condition control system according to claim 1, wherein the caution-condition signal output is digitally encrypted.

10. A racing caution-condition control system comprises:

a master control station having a master activation input and a master spread-spectrum transceiver, the master activation input being coupled to the master spread-spectrum transceiver and selectively causing the master spread-spectrum transceiver to send a caution-condition signal output;

a first caution-condition warning system that has a first spread-spectrum transceiver in communication with the master spread-spectrum transceiver, the first caution-condition warning system being activated when the first spread-spectrum transceiver receives the caution-condition signal from the master spread-spectrum transceiver; and a second caution-condition warning system, different from the first caution-condition warning system, that has a second spread-spectrum transceiver in communication with the master spread-spectrum transceiver, the second caution-condition warning system being activated when the second spread-spectrum transceiver receives the caution-condition signal from the master spread-spectrum transceiver.

11. The racing caution-condition control system according to claim 10, wherein the first and second spread-spectrum transceivers are configured to retransmit the caution-condition signal output.

12. The racing caution-condition control system according to claim 11, wherein the caution-condition signal output is digitally encrypted.

13. A racing caution-condition control system comprises:

a master control station having a master activation input and a transmitter, the master activation input being coupled to the transmitter and selectively causing the transmitter to send a caution-condition signal output;

a track caution-condition warning system that has a track receiver in communication with the transmitter, the track caution-condition warning system being activated when the track receiver receives the caution-condition signal from the transmitter;

a pit-row caution-condition warning system that has a pit-row receiver in communication with the transmitter, the pit-row caution-condition warning system being activated when the pit-row receiver receives the caution-condition signal from the transmitter; and an on-board vehicle caution-condition warning system that has at least one on-board vehicle receiver in communication with the transmitter, the at least one on-board vehicle caution-condition warning system being activated when the at least one on-board vehicle receiver receives the caution-condition signal, directly or indirectly, from the transmitter.

14. The racing caution-condition control system according to claim 13, further comprising:

an emergency medical-staff notification system having an emergency medical-staff receiver and a warning device, the emergency medical-staff receiver receives the caution-condition signal from the transmitter and activates the warning device.

15. The racing caution-condition control system according to claim 14, wherein the warning device is at least one of a siren, a horn, an indicator light and a dialer.

16. The racing caution-condition control system according to claim 13, further comprising:

an on-board vehicle master transceiver that receives the caution-condition signal from the transmitter and retransmits the caution-condition signal to the at least one on-board vehicle caution-condition warning system.

17. The racing caution-condition control system according to claim 13, further comprising:

an emergency pager system having at least one pager and an emergency pager receiver, the emergency pager receiver receives the caution-condition signal from the transmitter and activates the at least one pager.

* * * * *